US008020242B2

(12) United States Patent
Dow

(10) Patent No.: US 8,020,242 B2
(45) Date of Patent: Sep. 20, 2011

(54) HUMAN TORSO SCRUBBING APPARATUS

(76) Inventor: Michael J. Dow, Oak Forest, IL (US)

( * ) Notice: Subject to any disclaimer, the term of this patent is extended or adjusted under 35 U.S.C. 154(b) by 1060 days.

(21) Appl. No.: 11/825,707

(22) Filed: Jul. 9, 2007

(65) Prior Publication Data

US 2009/0013486 A1 Jan. 15, 2009

(51) Int. Cl.
*A46B 5/02* (2006.01)
*B21D 39/00* (2006.01)

(52) U.S. Cl. ..... 15/143.1; 29/428

(58) Field of Classification Search ..... 15/160, 15/143.1; 29/428
See application file for complete search history.

(56) References Cited

U.S. PATENT DOCUMENTS

| | | | |
|---|---|---|---|
| 269,247 | A | 12/1882 | Waters |
| 1,634,907 | A | 7/1927 | Lester |
| 1,993,215 | A | 3/1935 | Hoyt et al. |
| 2,011,729 | A | 8/1935 | Reinhard |
| 2,306,809 | A | 12/1942 | Jeung |
| 2,652,615 | A | 9/1953 | Lasley |
| 2,825,084 | A | 3/1958 | Sanborn |
| 2,846,708 | A | 8/1958 | Vosbikian et al. |
| 3,281,884 | A | 11/1966 | Feil |
| 3,343,196 | A | 9/1967 | Barnhouse |
| 3,345,668 | A | 10/1967 | Forrest |
| 3,877,105 | A | 4/1975 | Breland |
| 3,924,288 | A | 12/1975 | Breland |
| 3,959,841 | A | 6/1976 | Horne |
| 4,067,325 | A | 1/1978 | Olask |
| 4,077,083 | A | 3/1978 | Siemund et al. |
| 4,085,475 | A | 4/1978 | Silver |
| 4,196,490 | A | 4/1980 | Jonzon |
| 4,343,061 | A | 8/1982 | Hanazono |
| 4,462,135 | A | 7/1984 | Sanford |
| 4,473,929 | A | 10/1984 | Green |
| 4,475,836 | A | 10/1984 | Colognori |
| 4,761,849 | A | 8/1988 | Taylor |
| 5,205,012 | A | 4/1993 | Coley |
| 5,295,280 | A | 3/1994 | Hudson et al. |
| 5,323,506 | A | 6/1994 | Babitch |
| 5,426,810 | A | 6/1995 | Rones |
| 5,504,963 | A | 4/1996 | Bynum et al. |
| 5,528,792 | A * | 6/1996 | Nazemi ..... 15/160 |
| 5,687,447 | A | 11/1997 | Bynum et al. |
| 5,791,008 | A | 8/1998 | Crabtree |
| 5,850,662 | A | 12/1998 | Galvan-Garza |
| 5,875,511 | A | 3/1999 | Nejdl |
| 5,983,435 | A | 11/1999 | Osborne |
| 6,026,534 | A | 2/2000 | Gonda et al. |

(Continued)

OTHER PUBLICATIONS

Geddes; Easy Reach Back Brush; 2003.

(Continued)

*Primary Examiner* — Monica Carter
*Assistant Examiner* — Stephanie Newton
(74) *Attorney, Agent, or Firm* — Law Office of John W. Harbst

(57) ABSTRACT

A human torso scrubbing apparatus including an elongated handle having a grasping portion toward one end thereof. A scrubbing element is secured to a second end of the handle. The grasping portion of the handle is offset at an angle ranging between about 75° and about 115° relative to a portion of the handle extending from the scrubbing element so as to facilitate scrubbing of a human's back while the angular offset of said grasping portion allows said apparatus to freely hang when not in use.

13 Claims, 9 Drawing Sheets

U.S. PATENT DOCUMENTS

| | | | | |
|---|---|---|---|---|
| 6,092,258 | A | 7/2000 | Chen | |
| 6,105,196 | A | 8/2000 | Chang | |
| 6,131,234 | A | 10/2000 | Chen | |
| 6,210,057 | B1 | 4/2001 | Yannaci et al. | |
| 6,223,382 | B1 | 5/2001 | Schwab | |
| 6,276,022 | B1 | 8/2001 | Gallacher | |
| 6,443,527 | B1 | 9/2002 | Borcherds et al. | |
| 6,453,503 | B1 | 9/2002 | Chen | |
| 6,557,204 | B2 | 5/2003 | Maxwell | |
| 6,584,638 | B2 | 7/2003 | Nigh et al. | |
| 6,601,259 | B2 | 8/2003 | Chang | |
| 6,698,057 | B2 | 3/2004 | Varga | |
| 6,726,385 | B1 | 4/2004 | Borowski | |
| 6,754,929 | B2 | 6/2004 | Fichter | |
| 6,793,434 | B1 | 9/2004 | Olson | |
| 6,823,555 | B2 | 11/2004 | Warren | |
| 6,839,932 | B2 | 1/2005 | Huang | |
| 6,991,200 | B2 | 1/2006 | Sullivan | |
| 7,055,187 | B1 | 6/2006 | Fields | |
| 7,097,144 | B2 | 8/2006 | Kohno | |
| 7,197,827 | B2 | 4/2007 | Paquette | |
| 2002/0124340 | A1 | 9/2002 | Nolan | |
| 2002/0147060 | A1 | 10/2002 | Wolf | |
| 2002/0166189 | A1 | 11/2002 | Huang | |
| 2004/0021045 | A1 | 2/2004 | Stillman | |
| 2005/0028310 | A1 | 2/2005 | Huang | |
| 2005/0251940 | A1 | 11/2005 | Black | |
| 2006/0053574 | A1* | 3/2006 | Steinberg | 15/210.1 |
| 2007/0256264 | A1* | 11/2007 | Chen | 15/209.1 |
| 2008/0155773 | A1* | 7/2008 | Chen | 15/143.1 |

OTHER PUBLICATIONS

International Searching Authority/USPTO; International Search Report regarding PCT/US2008/008300; Oct. 7, 2008; 2 pages.

International Searching Authority/USPTO; Written Opinion of the International Searching Authority regarding PCT/US2008/008300; Oct. 7, 2008; 7 pages.

* cited by examiner

HUMAN TORSO SCRUBBING APPARATUS

FIELD OF THE DISCLOSURE

The present disclosure generally relates to bathing aides and, more particularly, to a stiff handled human torso scrubbing apparatus especially suited for scrubbing the human back while showering or bathing.

BACKGROUND OF THE DISCLOSURE

There are many types of cleansing devices that are useful for body washing and personal hygiene. Because it is awkward to reach one's own back, many people use back scrubbers to lather their backs while bathing or showering. Most such back scrubbers comprise a stiff, elongated and straight handled device with a sponge-like apparatus attached to one end. Although the stiffness of the handle of such scrubbing apparatus allows the user to better direct its movement during bathing, the straight line design of such known devices does not lend itself to simple and friendly use. To allow for their convenient storage, some such back scrubbers have a loop of string or the like at one end of the handle for allowing such device to be hung from a hook provided in the shower.

Within the last few years, nylon or elastomer mesh screening devices have become increasingly popular for personal hygiene use. Such devices have NYLON or elastomer mesh screening typically secured by a cord to form a ball or puff. Since they readily absorb soap and other skin cleansers, many people use such scrubbers for bathing. Thus, some have both a back scrubber and a mesh scrubber in their already crowded bathtubs and shower stalls.

Although many contributions have been made, providing a, long handled back scrubbing apparatus using NYLON or elastomer mesh at one end thereof continues to present a design challenge. Known methods for securing mesh screening to an elongated handle of a bathing device typically involve securing the mesh ball or puff only to a single side of the elongated handle thus further reducing the friendly or ergonomic use of such a handled bathing product. Moreover, the strings or the like used to secure the nylon or elastomeric mesh to the bathing handle tend to break, thus, destroying the useful life of such devices.

Largely because known straight-line designed back scrubbers make for an unwieldy cumbersome product, many consumers have turned to an elongated elastomer or NYLON mesh product having string loops or straps at opposite ends. While the two straps provide an excellent means for grasping and holding such device so as to allow the device to be pulled back and forth on a user's body, it remains an unwieldy and cumbersome product. Moreover, some have found such elongated elastomer or nylon mesh products fail to offer the same thorough cleansing affect provided by an elongated and stiff handled product.

Thus, there is a need and continuing desire for a stiff handled scrubbing apparatus which is easy to use and has a scrubbing element extending from opposed sides of one end of the handle to enhance ergonomic use of the scrubbing apparatus.

SUMMARY OF THE DISCLOSURE

According to one aspect, there is provided a human torso scrubbing apparatus including an elongated handle having a grasping portion toward one end thereof. A scrubbing element is secured toward a second end of the handle. In one embodiment, the grasping portion of the handle is offset at an angle ranging between about 75° and about 115° relative to a portion of the handle extending from the scrubbing element so as to facilitate scrubbing of a human's back.

Preferably, the handle is formed as a one-piece structure, with the grasping portion of the handle being joined to the portion of the handle extending from the scrubbing element along a curvature having a radius ranging between about 0.750 inches and about 1.5 inches. Besides facilitating manipulation of the scrubbing apparatus during use, the curvature on the handle permits the scrubbing apparatus to freely hang from a shower rod, towel bar, shower handle, and the like. In one form, the handle further includes structure for stabilizing the scrubbing apparatus as it hangs from the shower rod, towel bar, shower handle, and the like. In an alternative form, the handle defines an opening disposed toward a free end of the grasping portion of the handle.

In a preferred form, the gripping portion of the handle is specifically configured to further enhance handling and manipulation of the scrubbing apparatus during use. In a preferred embodiment, the scrubbing element is comprised of an elastomeric mesh material extending from both the inner and outer surfaces of the handle.

According to another aspect, there is provided a human torso scrubbing apparatus including an elongated handle having first and second axially spaced ends. The first end of the handle is configured with a pair of bifurcated arms defining an open-ended channel therebetween. The channel opens to inner and outer surfaces of the handle. A scrubbing element is insertable into the channel and between the bifurcated arms such that a portion of the scrubbing element is entrapped between the arms while remaining portions of the scrubbing element extend outwardly from the inner and outer surfaces of the handle. According to this aspect, an apparatus is provided for inhibiting inadvertent movement of that portion of the scrubbing entrapped between the arms of the handle.

In one form, the handle is formed from an injection molded material. Preferably, a gripping portion is defined toward the handle's second end. In a preferred form, the handle has first and second joined sections providing a generally L-shaped configuration to the handle between the first and second ends thereof. In this embodiment, the first and second sections of the handle are joined to each other along a radius to allow the scrubbing apparatus to freely hang when not in use. Preferably, the handle is further structured to inhibit the scrubbing apparatus from inadvertently falling from its hung position when not in use.

According to another aspect, there is provided a human torso scrubbing apparatus including an elongated handle having a generally L-shaped configuration between first and second axially spaced ends. The first end of the handle is configured with a pair of bifurcated arms defining an elongated and open-ended channel therebetween. The channel opens to inner and outer surfaces and to the first end of the handle. A scrubbing element is held in the channel and between the bifurcated arms such that a portion of the scrubbing element extends along and is entrapped between the arms while remaining portions of the scrubbing element extend from the first end and from the inner and outer surfaces of the handle. The handle further includes an apparatus for inhibiting inadvertent movement of that portion of the scrubbing entrapped between the arms of the handle.

In one form, the scrubbing element is mounted between the bifurcated arms of the handle by a modular clip operably secured to the handle. As such, and when replacement of the scrubbing element is desired and/or required, only the clip with the worn scrubbing element arranged in operable combination therewith can be quickly and readily interchanged with another modular clip thus avoiding the need and expense of changing the entire scrubbing apparatus.

Preferably, the handle is formed from an injection molded material. In one form, the handle includes first and second sections joined to each other along a convex radius so as to allow the scrubbing apparatus to freely hang from a towel bar, shower rod, or shower handle when not in use. Preferably, the handle further includes structure for inhibiting the scrubbing apparatus from inadvertently falling from its hung position when not in use.

According to another aspect, there is provided a method for making a human torso scrubbing apparatus. Such method includes the steps of: providing an elongated handle having first and second axially spaced ends, with the first end of said handle being configured with a pair of arms defining an open-ended channel of predetermined length therebetween. The channel opens to inner and outer surfaces of the handle. The method also includes the step of: creating a scrubbing element by pleating a tubular mesh material repeatedly upon itself and between opposite ends thereof. The next step in the process involves: arranging the pleated portion of the tubular mesh material between the arms of the handle until substantially the entire length of the channel is filled with the pleated portion of the scrubbing element and with remaining portions of the scrubbing element extending outwardly from the inner and outer surfaces of the handle. Another step in the process involves: securing the central pleated portion of the scrubbing element within the channel and between the bifurcated arms of the handle.

To inhibit shifting movements of the scrubbing element within the channel and relative to the handle, another step in the process preferably includes: providing multiple material engaging and flexible fingers in co operable combination with at least one of the arms of the handle and to one side of the central pleated portion of the tubular mesh material for snagging the mesh material and thereby inhibiting substantial shifting movements of the scrubbing element within the channel. In a preferred method, the step of securing the central pleated portion of the tubular mesh material within the channel and between the bifurcated arms of said handle involves the steps of: arranging the central pleated portion of said tubular mesh material within a modular clip having a length generally equal to or slightly shorter than the predetermined length of the channel defined by said handle; inserting said modular clip into the channel defined by the bifurcated arms of said handle; and securing said clip to said handle.

To facilitate use of the scrubbing apparatus, the method preferably includes the further step of: forming the handle with a generally L-shape between the first and second ends thereof. The method furthermore preferably includes the step of: configuring the generally L-shaped handle so as to inhibit the scrubbing apparatus from inadvertently falling from a towel bar structure or the like after the scrubbing apparatus is hung to dry.

In view of the above, an object of the present disclosure is to provide a human torso scrubbing apparatus which resolves those inconveniences mentioned above and is designed to facilitate manipulation of the scrubbing apparatus during use.

Another object of this disclosure is to provide a human torso scrubbing apparatus which is easily held during bathing and is operable to cleanse a person's back without undue strain on the person using same.

Still another object of this disclosure is to provide a human torso scrubbing apparatus which does not retain water used in cleansing, has far less liquid absorbency, and which can drip dry as it freely hangs when not in use.

Yet another object of this disclosure is to provide a human torso scrubbing apparatus which includes a scrubbing element extending through to both sides of an elongated handle and is positively held in position at one end of the handle but yet is easily and readily replacable when required or desired.

Another feature of this disclosure relates to a method of making a human torso scrubbing apparatus which resolves those inconveniences mentioned above and yet is economical to manufacture.

These and other objects, aims and advantages will become more readily apparent from the following drawings, detailed description and appended claims.

Figure 2:
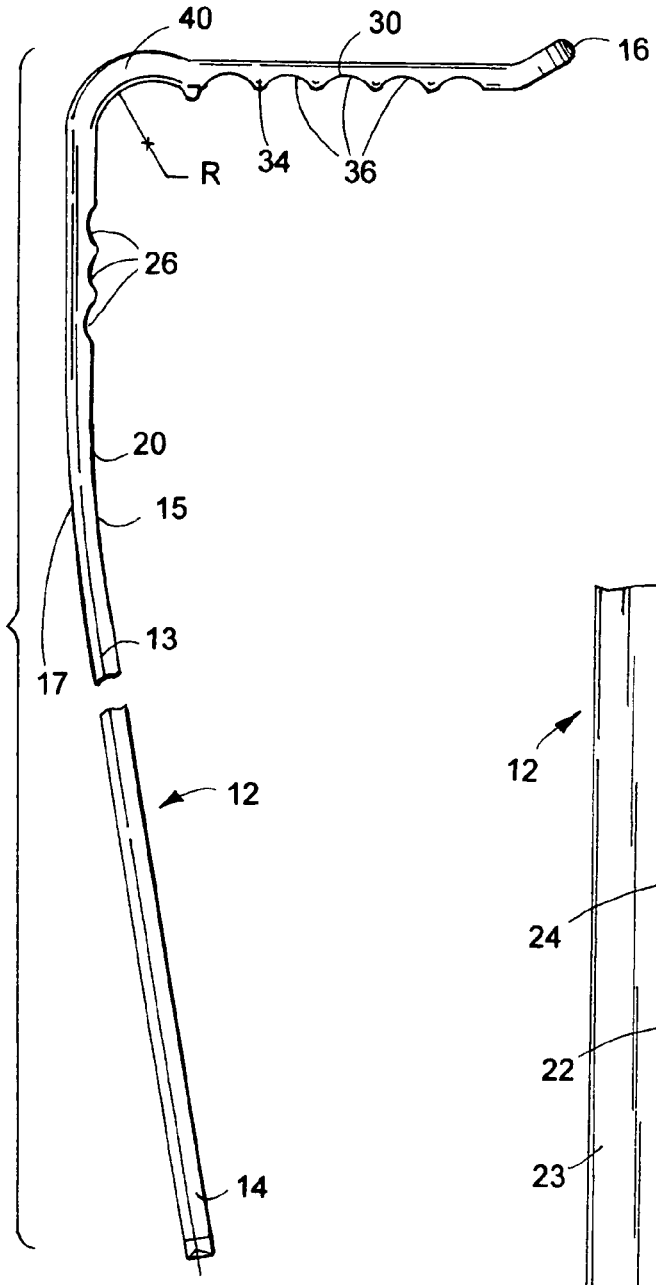
FIG. 2 is a side view of one embodiment of a handle forming part of the present disclosure.
Figure 9:
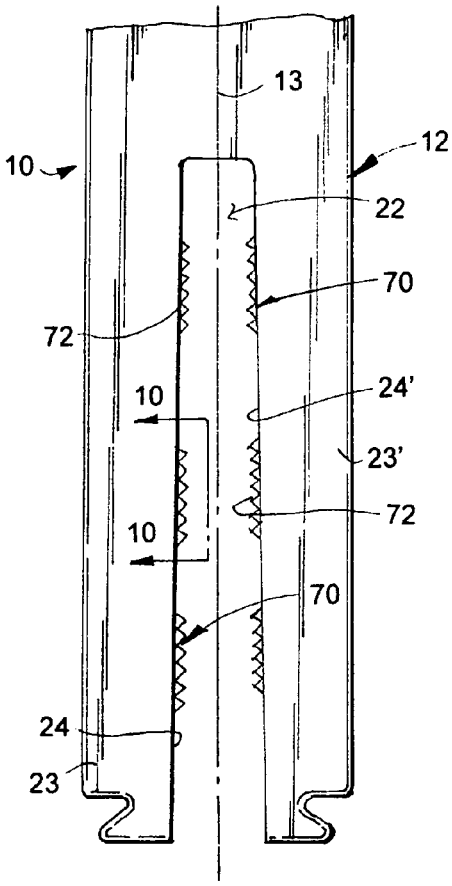
FIG. 9 is an enlarged fragmentary plan view similar to FIG. 5 showing structure for inhibiting inadvertent displacement of a scrubbing element relative to the handle during use of the scrubbing apparatus.
Figure 12:
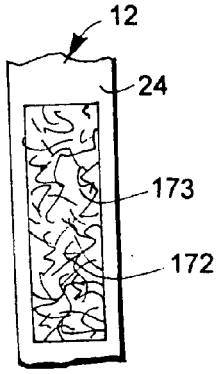
Figure 11:
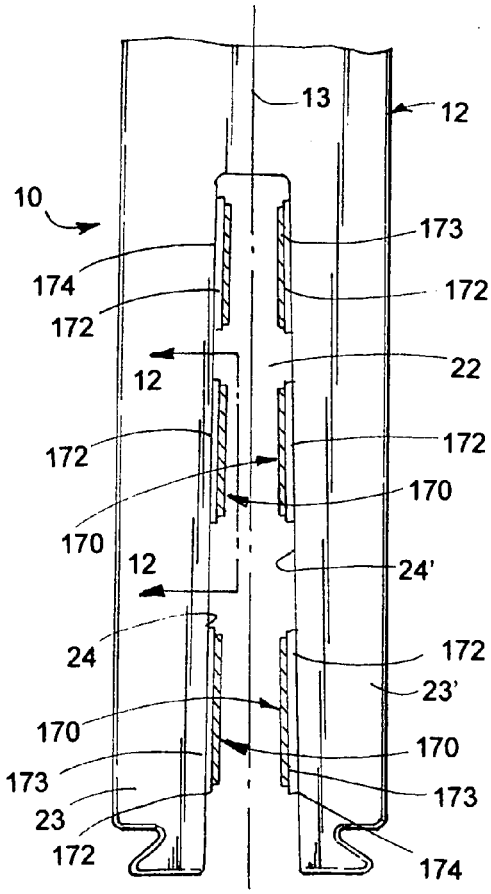
Figure 13:
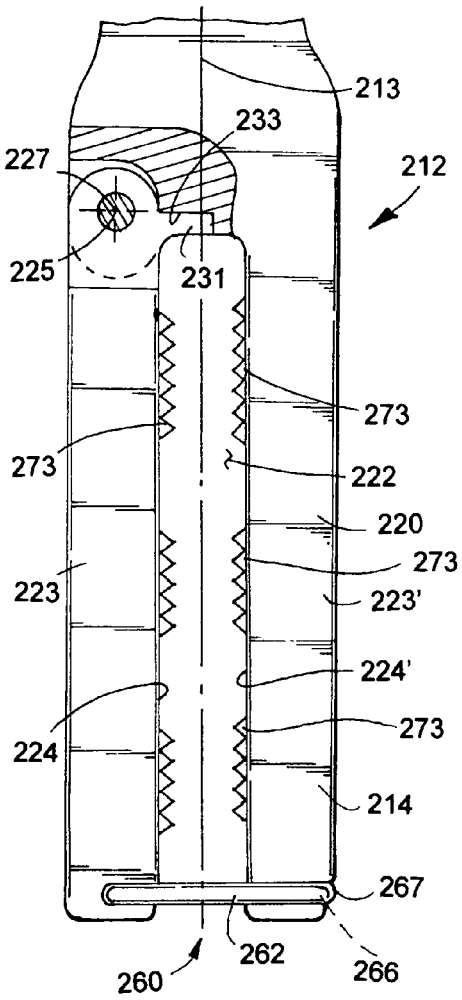
Figure 14:
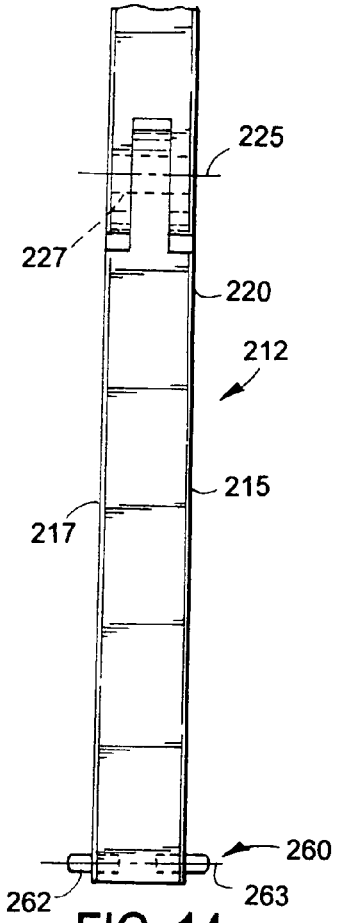
Figure 15:
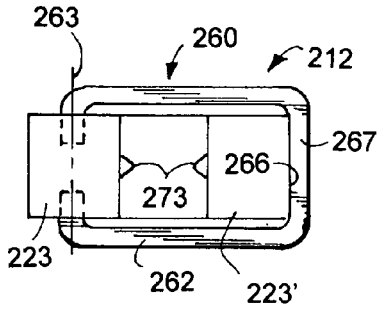
Figure 16:
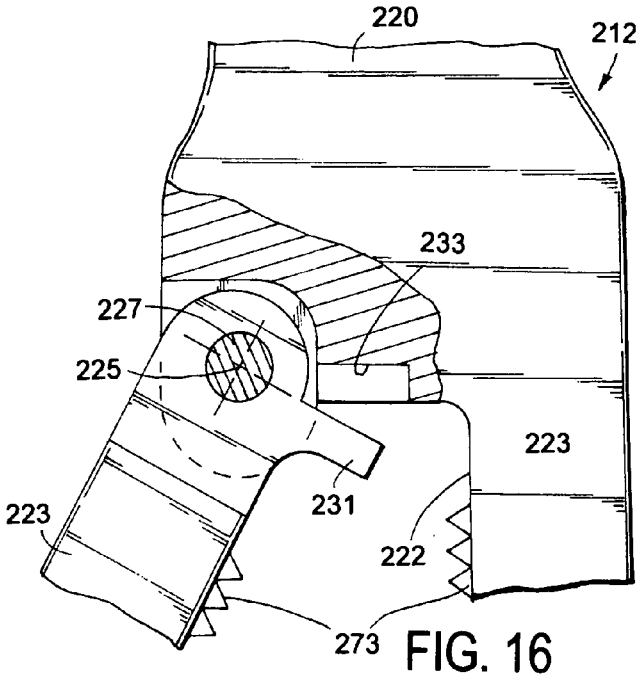
Figure 17:
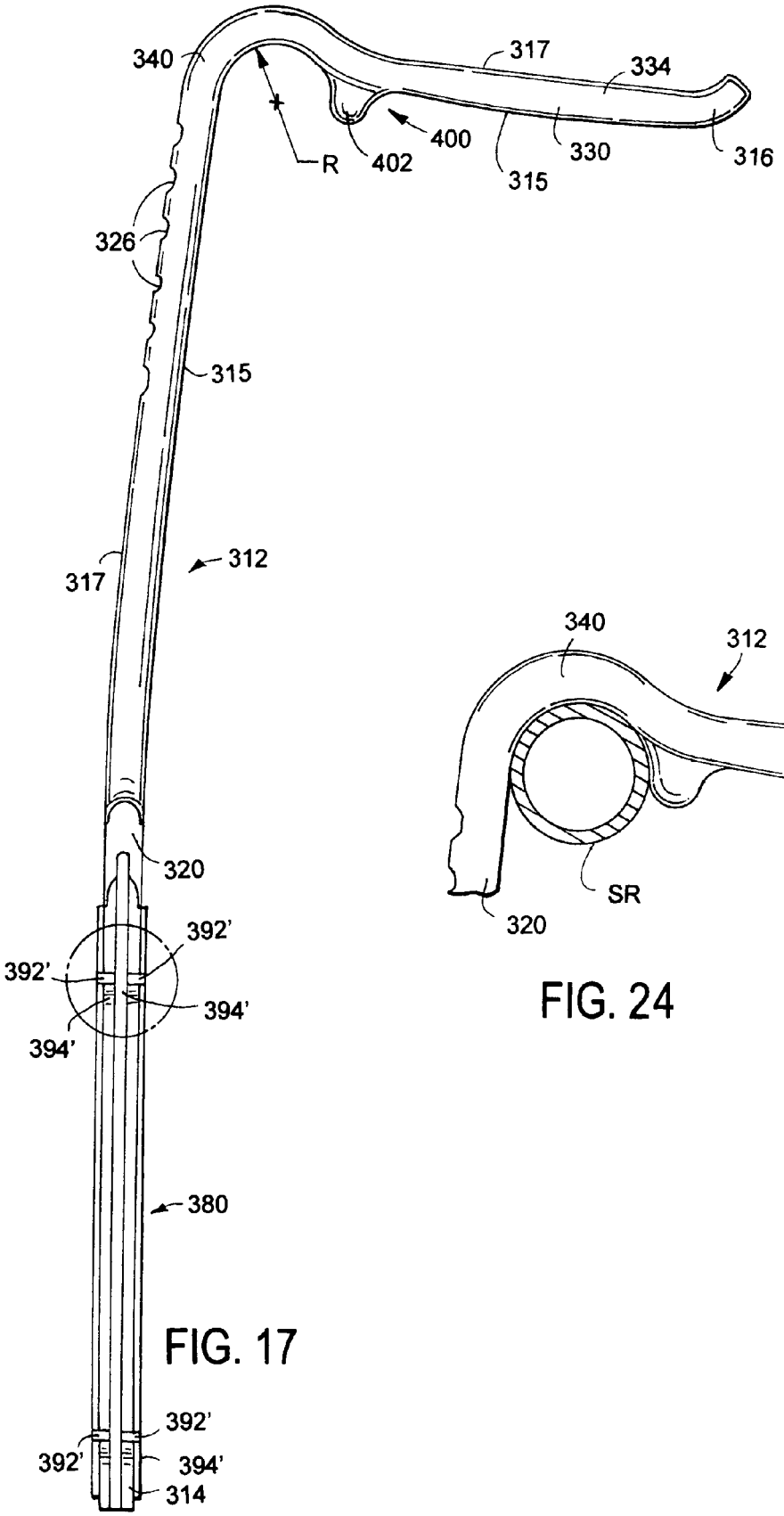
Figure 19:
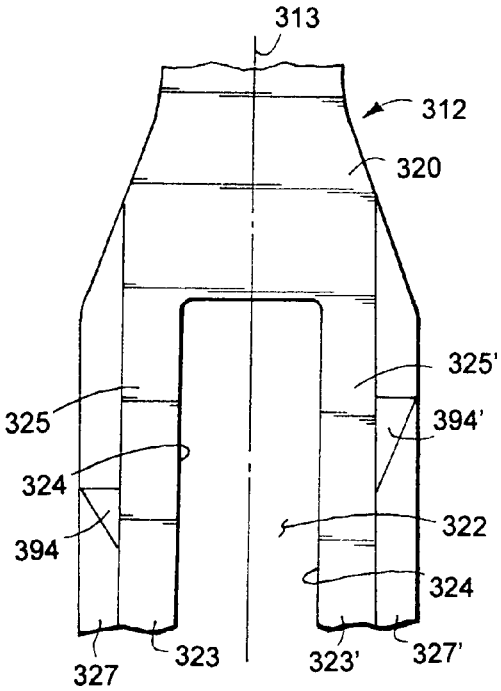
Figure 18:
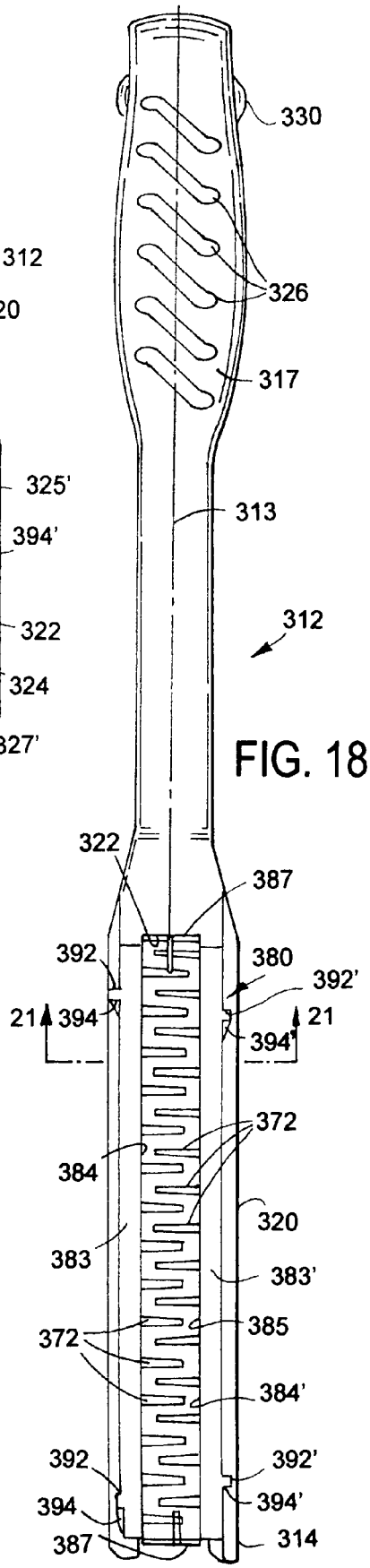
Figure 20:
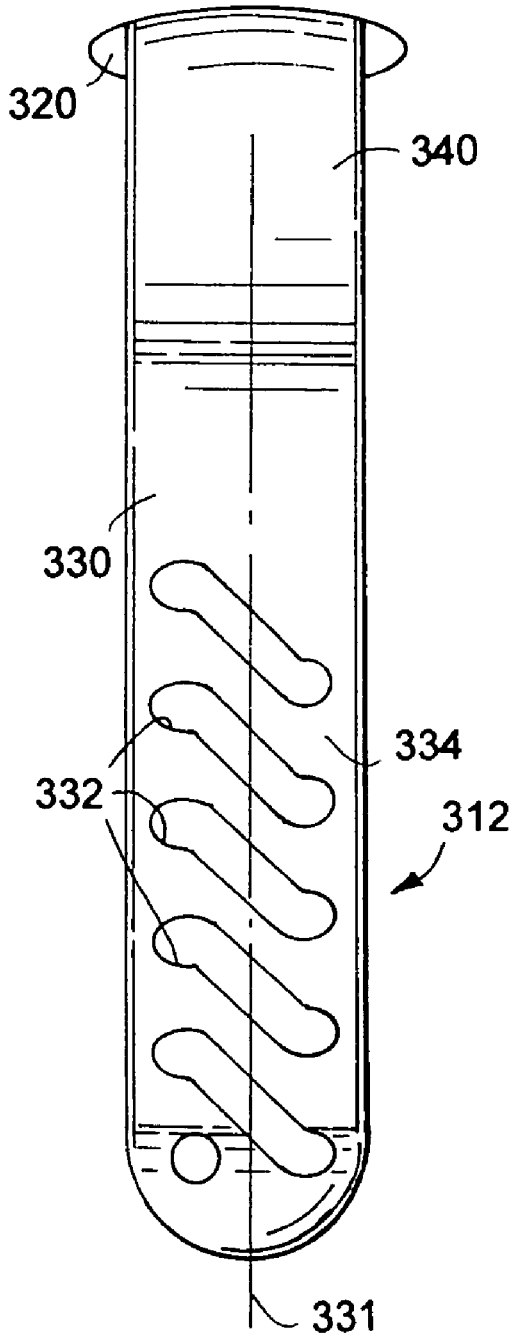
Figure 21:
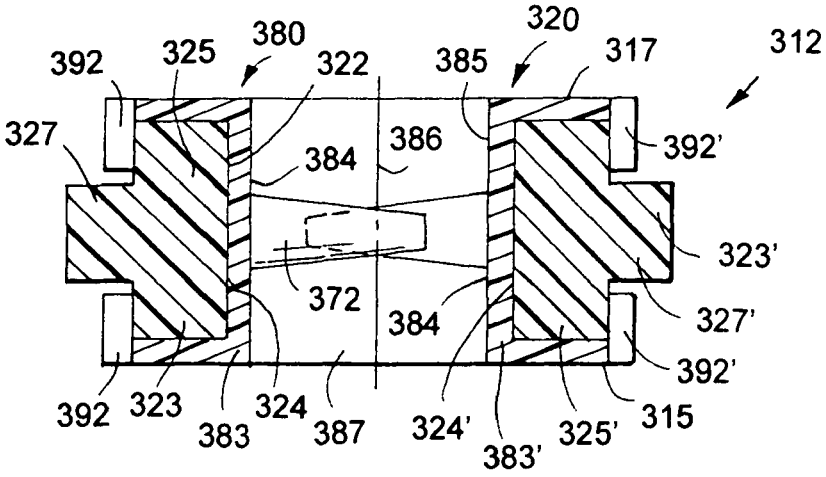
Figure 22:
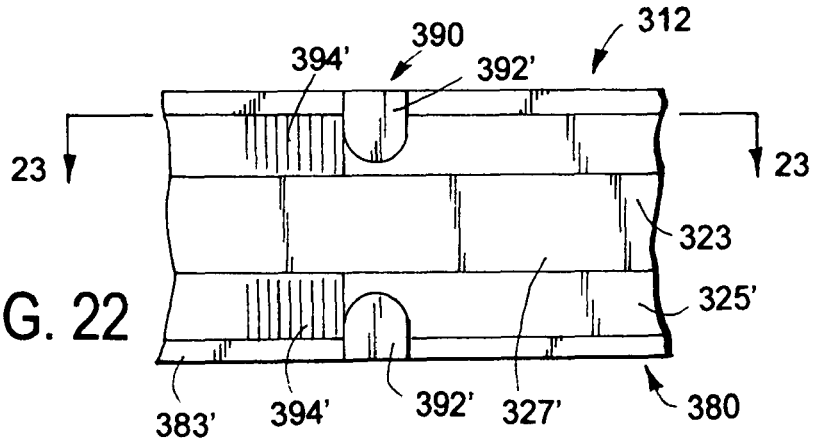
Figure 23:
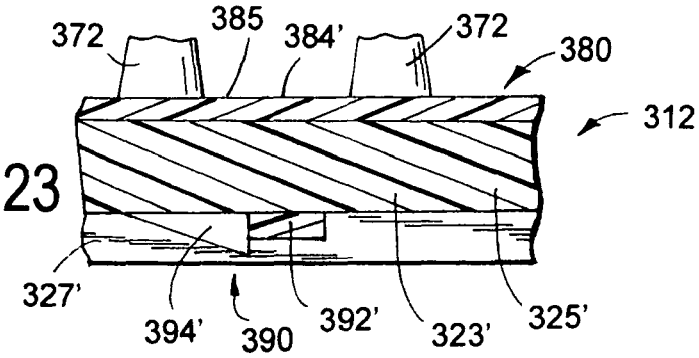

10 is a view taken along line 10-10 of FIG. 9;

FIG. 11 is an enlarged fragmentary plan view similar to FIG. 9 showing alternative structure for inhibiting inadvertent displacement of a scrubbing element relative to the handle during use of the scrubbing apparatus;

FIG. 12 is a view taken along line 12-12 of FIG. 11;

FIG. 13 is an enlarged fragmentary plan view similar to FIG. 9 showing another alternative embodiment of the scrubbing apparatus handle with the scrubbing element removed therefrom to show details of the scrubbing apparatus handle;

FIG. 14 is a fragmentary side view of the end of the handle shown in FIG. 13;

FIG. 15 is a fragmentary end view of a scrubbing element handle illustrated in FIG. 13;

FIG. 16 is an enlarged fragmentary side view of the scrubbing apparatus handle illustrated in FIG. 14 with one arm of the handle being pivotally moved relative to the other arm of the scrubbing apparatus handle;

FIG. 17 is an enlarged fragmentary side view similar to FIG. 2 showing another alternative embodiment of the scrubbing apparatus handle with the scrubbing element removed therefrom to show details of the scrubbing apparatus handle;

FIG. 18 is a front view of the scrubbing apparatus handle illustrated in FIG. 17;

FIG. 19 is an enlarged fragmentary front view of a portion of the scrubbing apparatus handle illustrated in FIG. 18;

FIG. 20 is an enlarged plan view of the scrubbing apparatus handle illustrated in FIG. 18;

FIG. 21 is an enlarged section view of taken along line 21-21 of FIG. 18;

FIG. 22 is an enlarged view of that area encircled in dash lines in FIG. 17;

FIG. 23 is a sectional view taken along line 23-23 of FIG. 22; and

Figure 24:
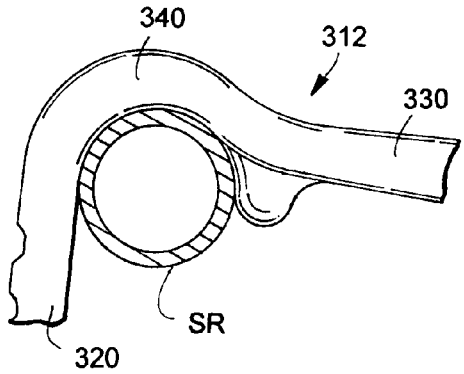

FIG. 24 is a fragmentary view of a scrubbing apparatus according to the present disclosure and including structure for inhibiting the scrubbing apparatus from inadvertently falling from a towel bar, shower rod and the like after being hung to dry.

DETAILED DESCRIPTION OF THE INVENTION

While the present invention is susceptible of embodiment in multiple forms, there is shown in the drawings and will hereinafter be described preferred embodiments of the disclosure, with the understanding the present disclosure is to be considered as setting forth exemplifications of the invention which are not intended to limit the disclosure to the specific embodiments illustrated and described.

Figure 1:
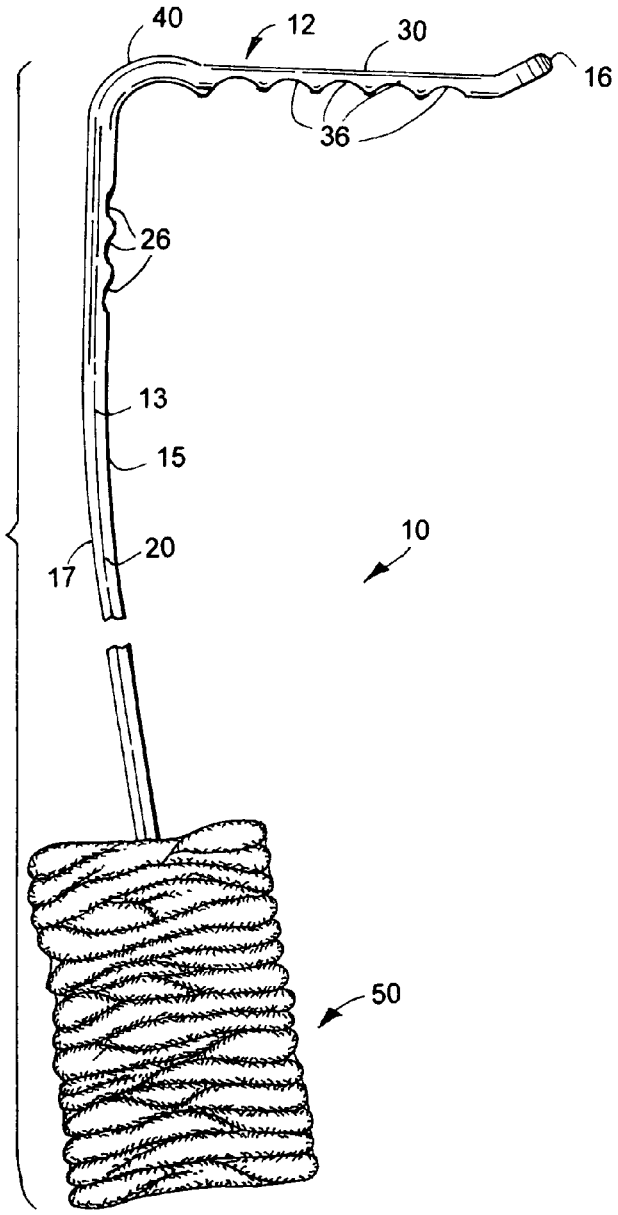
FIG. 1 is a side view of one form of a scrubbing apparatus embodying principals of the present disclosure.

Referring now to the drawings, wherein like reference numerals indicate like parts through the several views, there is shown in FIG. 1 one form of a human torso scrubbing apparatus, generally indicated by reference numeral 10. As shown, scrubbing apparatus 10 includes an elongated handle 12, defining an elongated axis 13, and a scrubbing element 50 secured toward a first end 14 (FIG. 2) of the handle 12.

Handle 12 is preferably formed from a suitable injection molded and relatively rigid material such as polypropylene, plastic, NYLON, and the like. As shown in FIG. 2, handle 12 also includes a second end 16 arranged in axially spaced relation from the first end 14. Between the first and second ends 14 and 16, respectively, handle 12 has inner and outer surfaces 15 and 17, respectively. Preferably, the inner and outer surfaces 15 and 17, respectively, are arranged in generally parallel relation relative to each other. In the embodiment illustrated in FIG. 2, a major portion of each surface 15, 17 has a generally planar or flat configuration. It should be appreciated, however, surfaces 15, 17 could have configurations other than planar or flat without detracting or departing from the spirit and scope of the invention.

As shown in FIG. 2, handle 12 has two sections 20 and 30. Handle sections 20, 30 are rigidly joined to each other to provide handle 12 with a generally L-shaped configuration between the ends 14 and 16. When joined to each other, the handle sections 20, 30 are offset or disposed at an angle ranging between about 70° and about 115° relative to each other. In a most preferred form, handle sections 20, 30 form and included angle ranging between about 85° and about 110° therebetween. Handle 12 is preferably of one-piece construction with sections 20 and 30 being integrally formed relative to each other. As shown in FIG. 1, handle section 20 extends from and has the scrubbing element 50 secured toward the first end 14 (FIG. 2) thereof.

In one embodiment, and over a major portion of its length, handle section 20 preferably has a curvilinear configuration. That is, as shown in FIGS. 1 and 2, and to facilitate use of the scrubbing apparatus 10, handle section 20 is configured such that the first end 14 angles slightly toward the second handle section 30. In one form, handle section 20 preferably has a length ranging between about 11 inches and about 20 inches. In a most preferred form, handle section 20 has a length of about 15 inches. In a preferred form, handle section 30 has a length of about 3.5 inches to about 7.0 inches. In a most preferred embodiment, handle section 30 has a length of about 5.25 inches.

To limit formation of stress risers in handle 12 and for other reasons discussed below, handle sections 20 and 30 are preferably joined to each other along a curved section 40. As shown, the curved section 40 of handle 12 has an inner radius R ranging between about 0.657 inches and about 1.5 inches. In a preferred form, the convex curved section 40 has an inner radius R of about 1.125 inches. Preferably, and in the handle section 30, the curved section 40 projects inwardly from the inner surface 15 of handle 12 and extends toward the outer surface 17 of handle 12. During use of the L-shaped scrubbing apparatus 10, and with a person's fingers wrapping about the outer surface 15 of handle section 30, curved section 40 readily accommodates the thumb of the person using apparatus 10 and enhances comfortable gripping of handle section 30. Furthermore, the curved section 40 of L-shaped handle 12 permits apparatus 10 to freely hang from a towel bar and/or shower rod to facilitate drying of apparatus 10.

Figure 3:
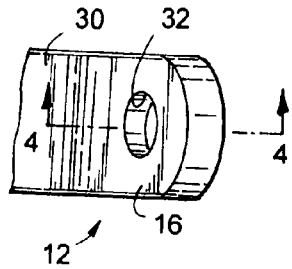
FIG. 3 is an enlarged top plan view of a distal end of one form of scrubbing apparatus handle.
Figure 4:
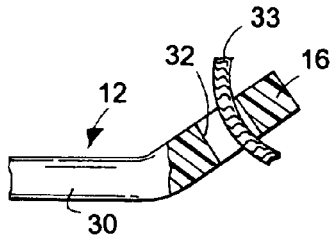
FIG. 4 is a sectional view taken along line 4-4 of FIG. 3.

As shown in FIGS. 3 and 4, a through bore or opening 32 is preferably defined toward the free or distal end of handle section 30. As shown, the through bore or opening 32 defined by handle 12 permits the scrubbing apparatus 10 to alternatively be hung from a hook (not shown) or the like when not in use. The through bore or opening 32 defined by handle 12 also permits a closed loop or rope or string 33 to be passed through the handle 12 whereby allowing the scrubbing apparatus to be hung from a hook (not shown) or the like when not in use. As shown in FIGS. 3 and 4, the distal end of handle section 30 can also embody an upturned configuration.

In a preferred embodiment, a length of handle section 30 further includes a gripping or grasping portion 34 provided toward the distal end and extending axially toward the curved section 40 of handle 12. In that embodiment shown in FIG. 2, the grasping portion 34 of handle section 30 is defined by a series of axially spaced and substantially identical undulations 36 preferably provided on the inner surface 15 of and extending laterally across handle section 30 in generally parallel relation relative to each other. In one form, the series of spaced undulations 36 extend along the inner surface 15 for a major portion of the lengthwise distance between the free end of handle section 30 and the curved section 40. Suffice it to say, the series of spaced undulations 36 are configured to accommodate a person's fingers thereby enhancing their grasp on the handle 12 of scrubbing apparatus 10 during use. Moreover, and in the area of the undulations 36, the inner surface 15 of handle section 30 is preferably textured to enhance grasping of the scrubbing apparatus 10 during use.

In the embodiment shown in FIG. 2, a length of the inner surface 15 of handle section 20 extending from the curved section 40 toward the first end 14 of handle 12 is likewise provided with a series of a series of axially spaced and substantially identical undulations 26. Like undulations 36, the series of spaced undulations 26 on handle section 20 serve to accommodate a person's fingers thereby enhancing their grasp on the handle 12 of scrubbing apparatus 10 during use. Moreover, and in the area of the undulations 26, the inner surface 15 of handle section 20 is preferably textured to enhance grasping of the scrubbing apparatus 10 during use.

Figure 5:
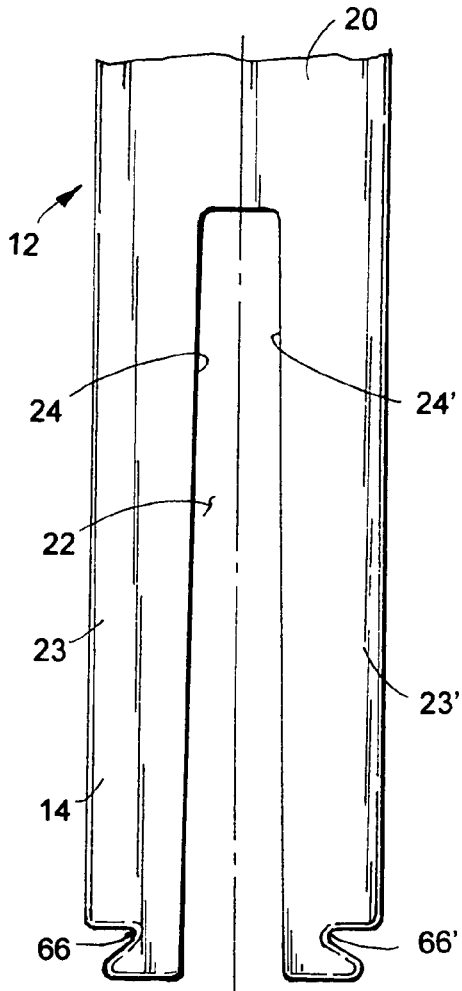
FIG. 5 is an enlarged fragmentary plan view of on an opposite end of the scrubbing apparatus handle.

As shown in FIG. 5, the elongated handle 12 further defines an elongated channel or slot 22 defining a pair of bifurcated arms 23 and 23' on opposite lateral sides of slot 22. As shown, slot or channel 22 opens to the inner and outer surfaces 15 and 17, respectively, of handle section 20. The open ended slot 22 has a predetermined width and a predetermined length. In the illustrated embodiment, one end of slot 22 opens to the free or distal end 14 of handle 12 while the other end of slot or channel 22 is closed. Preferably, the elongated channel or slot 22 is arranged in general axial alignment with the longitudinal axis 13 of handle 12.

Because handle 12 is preferably fabricated from an injection molded material, the bifurcated arms 23, 23' of handle 12 preferably have a degree of resiliency and a flexural memory which permits them to move away from each other and thereafter return to substantially the same position they were in prior to their flexure. The arms 23, 23' define a pair of confronting surfaces 24, 24', respectively, which are separated by the width and length of channel 22.

Figure 6:
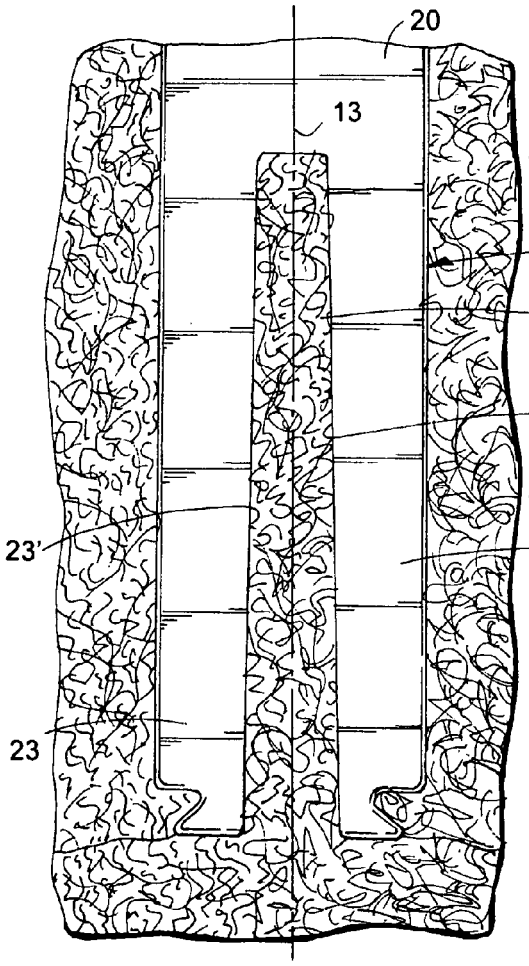
FIG. 6 is an enlarged view similar to FIG. 5 but showing, in partial longitudinal section, a portion of a scrubbing element operably associated with the handle.

As shown in FIG. 6, a portion of scrubbing element 50 is inserted lengthwise into the channel 22 of handle 12 and entrapped between the confronting surfaces 24, 24' on the arms, 23, 23', respectively, of handle 12 and such that portions of scrubbing element 50 extend from opposed sides 15 and 17 of handle 12. In a most preferred form, equal portions of scrubbing element 50 extend from opposed sides 15 and 17 of handle 12. Suffice it to say, the non-constricted portions of the scrubbing element 50 provide scrubbing element 50 with an outer configuration projecting outwardly from both surfaces 15, 17 of handle 12.

Scrubbing element 50 can be made of any suitable material for washing a human body. In a preferred embodiment, scrubbing element 50 is made of tubular netting material and preferably has open cells so as to allow water to pass therethrough and clean scrubbing element without retaining considerable moisture. The netting also preferably is made of non-porous material so that dirt and debris do not become entrapped in pores in the netting and so that the scrubbing element 50 will dry rapidly. Although it is not absolutely necessary, it is preferable for the netting to be elastic so that the portions of netting not entrapped between the arms 23, 23' of handle 12 can be stretched to add volume to the scrubbing element 50. Elasticity is also helpful because of the netting is stretched during use, it will return to its original shape after stretching.

The netting used to form element 50 is preferably tubular between opposed ends and can be repeatedly pleated, folded and/or layered upon itself to fit within channel 22 with those portions extending outside the channel 22 of handle 12 increasing the bulk of the scrubbing element 50. A preferred netting is diamond mesh polyethylene netting which can be obtained from any of several manufacturers. One such manufacturer is "NALTEX"®, 203 Colorado, Austin, Tex., 78701.

Figure 7:
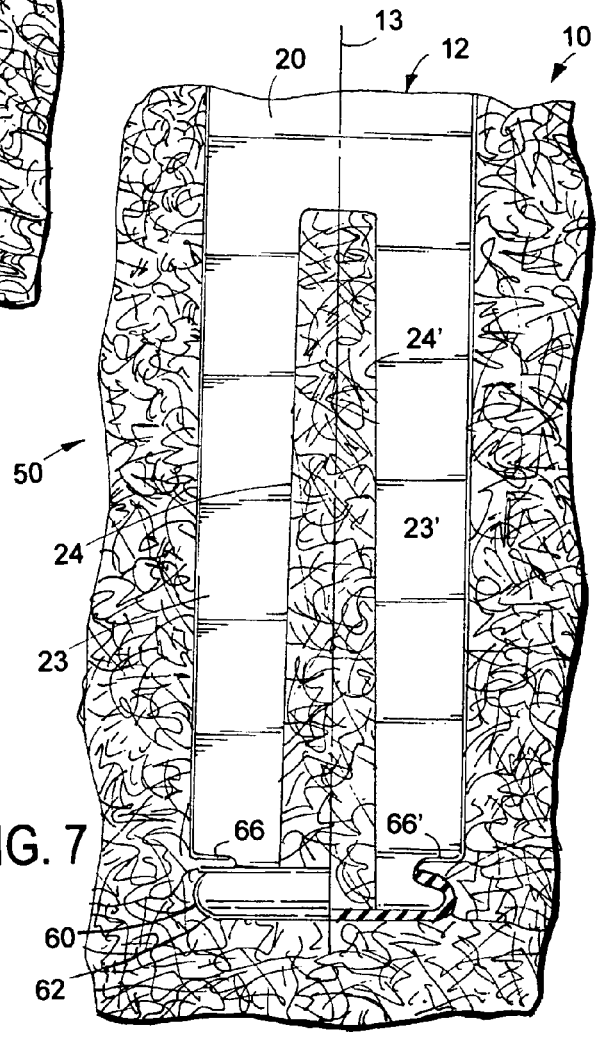
FIG. 7 is an enlarged view similar to FIG. 6 but showing, in partial longitudinal section, a portion of a scrubbing element clamped or otherwise secured to the handle.

In the embodiment shown in FIG. 7, scrubbing apparatus 10 further includes an apparatus, generally identified by reference numeral 60, for inhibiting inadvertent removal or escapement of the scrubbing element 50 from the channel 22 after the scrubbing element 50 is inserted there into. In one form, apparatus 60 also serves to operably interconnect the ends of arms 23, 23' of handle 12 to each other after the scrubbing element 50 disposed therebetween.

In the form shown in FIG. 7, apparatus 60 includes member 62 for joining the distal ends of the arms 23, 23' in operable association relative to each other. It should be appreciated, and as will be subsequently described, member 62 can take a myriad of different forms and shapes without detracting or departing from the spirit and scope of the present disclosure. In the form shown in FIG. 7, member 62 is configured as an elastomeric cap which operably combines with and fits over a pair of grooves 66, 66' defined toward the distal ends of and which open to the sides of arms 23, 23', respectively, of handle 12. Suffice it to say, during operation of scrubbing apparatus 10, member 62 operably holds the arms 23, 23' of handle 12 in relation relative to each other whereby capturing a portion of the scrubbing element 50 between the arms 23, 23'.

Figure 8:
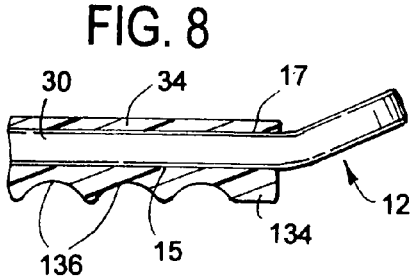
FIG. 8 is an alternative embodiment of a gripping portion of the scrubbing apparatus handle.

FIG. 8 shows an alternative embodiment for the gripping or grasping portion 34 of handle 12. In this alternative embodiment, the inner and outer surfaces 15 and 17, respectively, of handle section 30 each have a generally planar or flat configuration. In the embodiment shown in FIG. 8, an axially elongated elastomeric sleeve 134 is configured to snuggly fit over and along a length of handle section 30. As shown, sleeve 134 is provided with a series of axially spaced undulations 136 for accommodating a person's fingers thereby enhancing their grasp on the handle 12 of scrubbing apparatus 10 during use.

In a preferred embodiment, the scrubbing apparatus 10 is further configured to inhibit inadvertent shifting movements of the scrubbing element 50 relative to the handle section 20 after the scrubbing element 50 is inserted within the channel or slot 22. As will be appreciated, apparatus 10 can be configured and designed in different ways to inadvertent shifting movements of the scrubbing element 50 relative to the handle section 20 without detracting or departing from the true spirit and scope of the disclosure.

Figure 10:
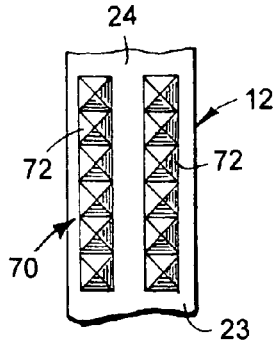

FIGS. 9 and 10 illustrate one type of apparatus, generally identified by reference numeral 70, for inhibiting the scrubbing element 50 (FIG. 7) from becoming inadvertently dislodged from or shifting within the channel 22 during use of the scrubbing apparatus 10. In the form shown in FIG. 9, confronting surfaces 24, 24' on the arms 23, 23', respectively, of handle 12 are configured with a series of material engaging fingers or points 72 projecting from their respective surface 24, 24' on each arm 23, 23', respectively, and toward the center of the channel 22. The multiple fingers or points 72 serve to operably engage with that portion of the material of the scrubbing element 50 (FIG. 6) entrapped between the arms 23, 23' whereby inhibiting the scrubbing element 50 from becoming inadvertently dislodged from the channel 22 during use of the scrubbing apparatus 10. The series of material engaging fingers or points 72 projecting from their respective surface 24, 24' on each arm 23, 23' and toward the center of the channel 22 can be molded integrally with the arms 23, 23' or, in an alternative form, can be secured thereto as with a suitable adhesive or epoxy or the like. Alternatively, only one of the respective surfaces 24, 24' of the arms 23, 23' can be provided with multiple fingers or points 72 serving to operably engage with the mesh material forming the scrubbing element 50 (FIG. 6) entrapped between the arms 23, 23' whereby inhibiting the scrubbing element 50 from becoming inadvertently becoming dislodged from the channel 22 during use of the scrubbing apparatus 10.

The multiple point structure 72 illustrated in FIGS. 9 and 10 is but one design for inhibiting the scrubbing element 50 (FIG. 7) from becoming inadvertently dislodged from or shifting within the channel 22 during use of the scrubbing apparatus 10. Consideration, however, must be given to the practical aspects of cost, manufacturing techniques, etc. as well as to the best possible structure which can be used to inhibit scrubbing element 50 (FIG. 7) from becoming inadvertently dislodged from or shifting within the channel 22 during use of the scrubbing apparatus 10.

In this regard, other designs and/or devices can also be used for inhibiting that portion of the scrubbing element 50 (FIG. 7) entrapped between the arms 23, 23' of handle 12 from becoming inadvertently dislodged from or shifting within the channel 22 during use of the scrubbing apparatus 10 without detracting or departing from the true spirit and scope of the present disclosure. For example, FIGS. 11 and 12 illustrate another form of apparatus, generally identified by reference numeral 170, for inhibiting that portion of the scrubbing element 50 (FIG. 7) entrapped between the arms 23, 23' of handle 12 from becoming inadvertently dislodged from or shifting within the channel 22 during use of the scrubbing apparatus 10.

In the form shown in FIG. 11, the confronting surfaces 24, 24' on the arms 23, 23', respectively, of the handle 12 are configured with at least one and preferably several axially spaced conventional and well known VELCRO® strips 172. As shown in FIG. 12, each VELCRO® strip includes multiple fabric or material engaging fingers 173 on a surface 174 projecting toward the toward the center of the elongated channel 22 (FIG. 11). As will be appreciated, the multiple fabric engaging fingers 173 on each VELCRO® strip 172 serves to operably engage with that portion of the material of the scrubbing element 50 (FIG. 6) entrapped between the arms 23, 23' whereby inhibiting the scrubbing element 50 from becoming inadvertently dislodged from the channel 22 during use of the scrubbing apparatus 10. The VELCRO® strips 172 can be secured to the confronting surfaces 24, 24' on the arms 23, 23' of handle 12 as with any suitable adhesive.

Alternatively, one or both of the respective surfaces 24, 24' on arms 23, 23' can be covered, in whole or in part, by a suitable adhesive material. A removable sheet would remain in protective relation relative to the adhesive until after the central pleated portion of the scrubbing element 50 is inserted between the arms 23, 23'. After the scrubbing element 50 is inserted between the arms 23, 23', the protective sheet would be removed whereby exposing and allowing the adhesive to bond to that portion of the scrubbing element 50 entrapped between the arms 23, 23' of handle 12 whereby inhibiting the scrubbing element 50 from becoming inadvertently dislodged from the channel 22 during use of the scrubbing apparatus 10.

FIGS. 13 through 16 illustrate an alternative form of handle for use with a scrubbing apparatus according to the present disclosure. This alternative form of scrubbing apparatus handle is designated generally by reference numeral 212 in FIGS. 13 through 16. The elements of this alternative handle design that are functionally analogous to those components discussed above regarding handle 12 are designated by reference numerals identical to those listed above with the exception this embodiment uses reference numerals in the 200 series.

Handle 212 is configured with an elongated configuration and, toward end 214, includes a pair of arms 223 and 223' defining an elongated slot 222 therebetween. The slot or channel 222 opens to the inner and outer surfaces 215 and 217, respectively, of handle section 220 (FIG. 14). In the illustrated embodiment, one end of slot 222 opens to the free or distal end 214 of handle 212 while the other end of slot or channel 222 is closed. Preferably, the elongated channel or slot 222 is arranged in general axial alignment with the longitudinal axis 213 of handle 212.

In the illustrated embodiment, arm 223 of handle 212 is pivotally movable in a plane generally parallel to and relative to arm 223' of handle 212. As shown, arm 223 is pivoted for movement about an axis 225 extending generally normal to surfaces 215 and 217 of handle 212 and defined by a pivot pin 227 disposed a distance from the free end of arm 223'. Of course, alternative designs from that illustrated for exemplary purposes can be readily used to effect pivotal movement of arm 223 relative to arm 223'. In the illustrated embodiment, the distance separating pivot pin 227 from the free end of arm 223 is preferably equal to or slightly greater than the overall length of arm 223'.

As shown in FIGS. 13 and 16, handle 212 is preferably configured to limit pivotal movement of arm 223 in a counterclockwise direction and relative to arm 223' so as to control the width of the slot or channel 222 when arm 223 is pivoted into a predetermined position relative to arm 223'. In one form, and proximate that end disposed adjacent to pivot pin 227, arm 223 is preferably provided with a limit stop 231 extending radially from and which rotates with arm 223 and is configured to co act with a seat 233 defined by handle 212 toward the closed end of the elongated slot 222.

As shown in FIGS. 13 and 16, the limit stop 231 of arm 223 has substantially no effect on pivotal movement of arm 223 in a direction away from arm 223'. Rotation of the arm 223 in a direction toward arm 223', however, causes stop 231 to engage and cooperate with the seat 233 in limiting movement of the arm 223 toward arm 223'. In the illustrated embodiment, the stop 231 and seat 233 cooperate with each other to allow for pivotal movement of the arm 223 toward arm 223' until confronting surfaces 224, 224' on the arms 223, 223', respectively, of handle 212 are spaced a predetermined distance apart and are arranged in generally parallel relation relative to each other. As will be appreciated, the ability to rotate arm 223 relative to arm 223' can be beneficial when arranging a portion of scrubbing element 50 therebetween.

In the embodiment shown in FIGS. 13, 14 and 15, handle 212 further includes an apparatus, generally identified by reference numeral 260, for inhibiting inadvertent removal or escapement of the scrubbing element from the channel 222 after the scrubbing element is inserted there into. In one form, apparatus 260 also serves to operably interconnect the ends of arms 223, 223' of handle 212 to each other after the scrubbing element is disposed therebetween.

In the form shown in FIGS. 13, 14 and 15, apparatus 60 includes a generally U-shaped member 262 for joining the distal ends of the arms 223, 223' in operable association relative to each other. Of course, member 262 can take a myriad of different forms and shapes without detracting or departing from the spirit and scope of the present disclosure. In the form shown, opposed free ends of member 262 are pivotally connected toward the free end of arm 223 such that member 262 is free to rotate about a pivot axis 263 (FIG. 15). As shown in FIG. 13, arm 223' defines a groove 266 defined toward the distal end of and which open to an outwardly facing edge or side of 212. Groove 266 is configured to releasably receive and hold a bight portion 267 of member 262 there within. Suffice it to say, during operation of the scrubbing apparatus, member 262 operably holds the arms 223, 223' of handle 212 in relation relative to each other whereby capturing a portion of the scrubbing element between the arms 223, 223'. When arm 223 is to be rotated relative to arm 223', the bight portion 267 of member 262 is manipulated and removed from groove 266 whereby allowing for rotation of arm 223 relative to arm 223'.

Preferably, the confronting surfaces 224, 224' on opposed sides of the slot or channel 220 are configured to inhibit inadvertent shifting movements that portion of the of scrubbing element placed therebetween relative to the handle section 220 of handle 212. As mentioned above, different configurations and designs can be used to inadvertent shifting movements of the scrubbing element relative to the handle section without detracting or departing from the true spirit and scope of the disclosure.

In the embodiment illustrated in FIGS. 13 and 16, multiple fabric or material engaging fingers 273 extend from the confronting surfaces 224, 224' and are directed toward the centerline 213 for operably engaging with that portion of the material of the scrubbing element entrapped between the arms 223, 223' whereby inhibiting the scrubbing element from becoming inadvertently dislodged from the channel 222 during use of the scrubbing apparatus.

FIGS. 17, 18 and 20 illustrate an alternative form of handle for use with a scrubbing apparatus according to the present disclosure. This alternative form of scrubbing apparatus handle is designated generally by reference numeral 312 in FIGS. 17, 18 and 20. The elements of this alternative handle design that are functionally analogous to those components discussed above regarding handle 12 are designated by reference numerals identical to those listed above with the exception this embodiment uses reference numerals in the 300 series.

As shown in FIG. 17, handle 312 includes a first end 314 and a second end 316 arranged in axially spaced relation from the first end 314. Between the first and second ends 314 and 316, respectively, handle 312 has inner and outer surfaces 315 and 317, respectively. Preferably, the inner and outer surfaces 315 and 317, respectively, are arranged in generally parallel relation relative to each other.

Handle 312 has two sections 320 and 330 which, in one form, are rigidly joined to each other to provide handle 312 with a generally L-shaped configuration between the ends 314 and 316. When joined to each other, the handle sections 320, 330 are offset or disposed at an angle ranging between about 70° and about 115° relative to each other. In a most preferred form, handle sections 320, 330 form and included angle ranging between about 85° and about 110° therebetween. Handle 312 is preferably of one-piece construction with sections 320 and 330 being integrally formed relative to each other. A scrubbing element is secured toward the first end 314 of the handle 312.

In one embodiment, and over a major portion of its length, handle section 320 preferably has a curvilinear configuration. That is, handle section 320 is configured such that the first end 314 angles slightly toward the second handle section 330. In one form, handle section 320 preferably has a length ranging between about 11 inches and about 20 inches. In a most preferred form, handle section 320 has a length of about 15 inches. In a preferred form, handle section 330 has a length of about 3.5 inches to about 7.0 inches. In a most preferred embodiment, handle section 330 has a length of about 5.25 inches.

To limit formation of stress risers in handle 312 and for other reasons, handle sections 320 and 330 are preferably joined to each other along a curved section 340. As shown in FIG. 17, the curved section 340 of handle 312 has an inner radius R ranging between about 0.657 inches and about 1.5 inches. In a preferred form, the convex curved section 340 has an inner radius R of about 1.125 inches. Preferably, and in the handle section 330, the curved section 340 projects inwardly from the inner surface 315 of handle 312 and extends toward the outer surface 317 of handle 12. During use of the L-shaped scrubbing apparatus 10, and with a person's fingers wrapping about the outer surface 315 of handle section 330, the curved section 340 readily accommodates the thumb of the person using the scrubbing apparatus and enhances comfortable gripping of handle section 330. As shown in FIG. 24, the curved section 340 of L-shaped handle 312 permits the scrubbing apparatus to freely hang from a towel bar and/or shower rod SR to facilitate drying of the scrubbing element.

A length of handle section 330 further includes a gripping or grasping portion 334 provided toward the free distal end and extending axially toward the curved section 340 of handle 312. In that embodiment shown in FIG. 20, the grasping portion 334 of handle section 330 is defined by a series of openings 332 which are angled relative to the longitudinal axis 331 of the handle section 330. The axially spaced openings 332 are configured to enhance a person's grasp on the handle 312.

As shown in FIGS. 17 and 18, a length of the outer surface 317 of handle section 320 extending from the curved section 340 toward the first end 314 of handle 312 is configured to enhance the grasp of handle 312. Preferably, a series of axially spaced recesses 326 are defined on the outer surface 317 of handle section 320 and serve to enhance a person's grasp on the handle 312. As shown in FIG. 18, the axially spaced recesses 326 have a generally reverse S-shaped profile and are angled relative to a longitudinal axis 313 of the handle section 320.

As shown in FIG. 19, section 320 of handle 312 further defines an elongated channel or slot 322 defining a pair of bifurcated arms 323 and 323' on opposite lateral sides of slot 322. As shown in FIG. 21, each arm 323, 323' preferably has a generally T-shaped cross-sectional configuration. More specifically, and in one form, each arm 323, 323' of section 320 on handle section 320 includes a longitudinally extending head section 325, 325', respectively, along with a generally centralized and longitudinally extending shank section 327, 327'. As shown, the shank section 327, 327' on each arm 323, 323', respectively, extends outwardly from the head section 325, 325', respectively. Both the longitudinally extending head section 325, 325' and the longitudinally extending shank section 327, 327' have a predetermined width and height. The slot or channel 322 defined by the arms 323, 323' opens to the inner and outer surfaces 315 and 317, respectively, of handle section 320. Moreover, the open ended slot 322 has a predetermined width and a predetermined length. In the illustrated embodiment, one end of slot 322 opens to the free or distal end 314 of handle 312 while the other end of slot or channel 322 is closed. Preferably, and as shown in FIG. 19, the elongated channel or slot 322 is arranged in general axial alignment with the longitudinal axis 313 of the handle section 320.

Because handle 312 is preferably fabricated from an injection molded material, the bifurcated arms 323, 323' of handle 312 preferably have a degree of resiliency and a flexural memory permitting them to move away from each other and thereafter return to substantially the same position they were in prior to their flexure. The arms 323, 323' define a pair of confronting surfaces 324, 324', respectively, which are separated by the width and length of channel 322.

FIGS. 17 and 18 illustrate still another form of apparatus for receiving and inhibiting a scrubbing element from becoming inadvertently dislodged from the channel 322 during use of the scrubbing apparatus. In the embodiment shown in FIGS. 17, 18 and 21, a modular scrubbing element clip or holder 380 receives and accommodates a scrubbing element for use in operable combination with handle 312.

Holder 380 is preferably fabricated from an injection molded material such as polypropylene, plastic, NYLON, and the like. As shown in FIGS. 18 and 21, the holder or clip 380 includes two generally parallel arms 383, 383' which are separated by a predetermined distance relative to each other and define a channel 385 therebetween. Each arm 383, 383' has a length about equal to the length of the arms 323,323' of handle 312. The arms 383, 383' define confronting surfaces 384, 384', respectively, on opposed sides of a longitudinal axis 386 of the channel 385. Preferably, and as shown in FIG. 18, after scrubbing element holder 380 is arranged in operable combination with the handle 312, the modular scrubbing element or holder 380 substantially fills the longitudinal length of channel 322 with the axis 386 of channel 385 being arranged in general alignment with the longitudinal axis 313 of handle section 320 (FIG. 19). As shown in FIG. 18, the arms 383, 383' of holder 380 are maintained in predetermined spaced relation relative to each other by opposed and rigid ends 387, 387'. In one form, the rigid end 387 is hingedly connected or joined along both sides or edges to the arms 383, 383'. In the form illustrated for exemplary purposes, the rigid end 387' is hingedly connected or joined along one side or edge to one of the arms 383, 383' while the other side or edge of end is operably coupled to the other arms 383, 383'. As such, the clip or holder 380 can be opened to allow insertion of the scrubbing element between the arms 383, 383' whereby filling the channel 385 between the ends 387, 387'. In the illustrated embodiment, the arms 383, 383' along with the ends 387, 387' combine with each other to provide the clip or holder 380 with a generally rectangular and hollow shape or profile.

In the illustrated embodiment, arms 323, 323' of the handle section 320 and the arms 383, 383' of the clip or holder 380 are configured to allow holder 380 to be substantially fill the length of the channel 322 after clip 380 is operably engaged, preferably in longitudinal sliding relationship with the first end 314 of handle 312 and between the confronting surfaces 324, 324' of channel 322. In the illustrated embodiment, the arms 323, 323' of the handle section 320 and the arms 383, 383' of the clip or holder 380 are preferably configured to establish a tongue and groove-like relationship between interior surfaces on the arms 323, 323' of the handle section 320 and exterior sides of the arms 383, 383' on the scrubbing element holder 380.

The clip or holder 380 is furthermore configured to inhibit that potion of the scrubbing passing therethrough from becoming inadvertently dislodged from between the arms 383, 383' of holder 380 after the clip or holder 380 is inserted between the arms 323, 323' of the scrubbing apparatus handle 312. As will be appreciated, the clip or holder 380 can be configured and designed in multiple ways for inhibiting that portion of the scrubbing element passing between the arms 383. 383' from becoming inadvertently dislodged form the clip or holder 380 after the holder 380 is operably coupled to the scrubbing apparatus handle 312 without detracting or departing from the true spirit and scope of the disclosure.

In the exemplary embodiment shown in FIGS. 18 and 21, the scrubbing element clip 380 is configured with rows of multiple fingers or points 372 serving to operably engage with the mesh material forming the scrubbing element adapted to be entrapped between the arms 383, 383' of the scrubbing element holder 380 whereby inhibiting the scrubbing element from becoming inadvertently dislodged from the channel 322 during use of the scrubbing apparatus. In one form, one or preferably both confronting surfaces 384, 384' of the arms 383, 383', respectively, of holder 380 are configured with a plurality of axially spaced flexible material engaging fingers or pins 387 projecting toward the toward the axis 386 of the elongated channel 385 defined by holder 380. The multiple fabric engaging fingers 387 serve to operably snag and engage with that portion of the mesh material forming the scrubbing element entrapped between the arms 383, 383' of holder 380 whereby inhibiting the scrubbing element from inadvertently becoming dislodged from the channel 385 of holder 380 or from the handle 312 during use of the scrubbing apparatus 10.

Moreover, and as shown in FIGS. 22 and 23, the scrubbing element clip or holder 380 and the handle section 320 define cooperating instrumentalities 390 for releasably maintaining the scrubbing element clip or holder 380 in longitudinally fixed relation relative to the free end of the handle section 320 after the scrubbing element or holder 380 is arranged in operable combination with the handle 312. As shown in FIG. 21, each arm 383, 383' of the holder 380 is provided with a plurality of flexible and free ended lugs 392, 392' preferably formed integral with the arms 383, 383' of the scrubbing element holder 380. As shown in FIG. 21, and after the scrubbing element holder or clip 380 is longitudinally inserted into the channel 322, the lugs 392, 392' are arranged on opposed sides of the shank section 327, 327', respectively, of each arms 323,k 323', respectively, of the scrubbing element holder 380. As shown, each lug 392, 392' is spaced outwardly of the predetermined width of the head section 325, 325' of the arms 323, 323' of the handle section 312. Moreover, and as shown in FIGS. 21 and 22, each lug 392, 392' extends toward but terminates short of the longitudinally extending shank section 327, 327' of each arm 323, 323', respectively, of handle section 312. As such, the lugs 392, 392' on the scrubbing element holder 380 serve to entrap the head section 325, 325' and shank portions 327, 327' of the arms 323, 323', respectively, of the handle section 312 therebetween.

As shown in FIG. 18, the arms 323, 323' on the handle section 312 preferably furthermore include stationary cams 394, 394' which cooperate with the lugs 392, 392', respectively, to releasably maintain the scrubbing element holder 380 and thereby the scrubbing element carried thereby against inadvertent longitudinal displacement relative to the handle section 312 during operation of the scrubbing apparatus. As the scrubbing element holder or clip 380 is slidably moved longitudinally into the channel 322 of handle 312, the lugs or tabs 392, 392' carried with and by the scrubbing element clip or holder 380 engage the stationary cams 394, 394' on the handle section 312. As the clip 380 is longitudinally inserted into slot 322, the cams 394, 394' serve a dual purpose. First, the stationary cams 394, 394' serve to urge the lugs or tabs 392, 392' outwardly and past the cams 394, 394' whereby allowing for continued insertion of the scrubbing element clip or holder 380 into the channel 322. In this regard, the flexibility of the arms 383, 383' of the scrubbing element holder 380 promotes flexibility of the tabs 392, 392'. Second, and after the lugs or tabs 392, 292' pass over the cams 394, 394', respectively, the cams 394, 394' inhibit inadvertent reverse movement of the scrubbing element clip or holder 380 whereby releasably securing the holder and the scrubber element carried thereby in proper position between the arms 323, 323' of the handle section 312 of the scrubbing apparatus. As will be appreciated, the closed configuration of the channel or slot 322 limits axial insertion of the scrubbing element holder or clip 380 into the handle 312 of the scrubbing apparatus.

Returning to FIG. 17, the L-shaped handle 312 of scrubbing apparatus 10 can further include structure, generally identified in FIG. 17 by reference numeral 400, for inhibiting the scrubbing apparatus from inadvertently falling from a shower rod SR, towel bar, shower handle, or the like from which it freely hangs (FIG. 24). As mentioned, the preferable and generally L-shape of the handle 312 advantageously permits the scrubbing apparatus of the present disclosure to freely hang from a shower rod, towel bar, shower handle, or the like. In a preferred form, structure 400 includes a projection 402 extending away from the inner surface 315 of handle section 330 and serves as an extension of the curved section 340. Preferably, projection 402 is integrally molded with the handle 312. Moreover, structure 400 has proven beneficial in ergonomically controlling the scrubbing apparatus 10 during use.

A method for making a human torso scrubbing illustrated in the drawings includes the following steps: providing an elongated handle having first and second axially spaced ends, respectively, with the first handle end being configured with a pair of bifurcated arms defining a longitudinally elongated and preferably open-ended channel therebetween. The method also includes the step of: creating a scrubbing element by pleating a tubular mesh material repeatedly upon itself and between opposite ends thereof such that a central pleated portion of the scrubbing element can be accommodated between the bifurcated arms and within the channel of the elongated handle. The next step in the process involves: arranging the central pleated portion of the scrubbing element between the bifurcated arms of the handle. Preferably, the pleated section of the scrubbing element substantially fills the predetermined length of the channel while those portions of the scrubbing element not between the bifurcated arms extends outwardly from inner and outer surfaces of the handle to promote scrubbing of a person's torso. The next step involves: securing the central pleated portion of the scrubbing element between the bifurcated arms of the handle of the scrubbing apparatus.

The step of securing the central pleated portion of the scrubbing element between the bifurcated arms of the handle of the scrubbing apparatus can be accomplished using various methods. According to one method, the central pleated portion of the scrubbing element is clamped between the bifurcated arms of the handle and free ends of the bifurcated arms are secured to each other to prevent inadvertent movement of the scrubbing element from between the bifurcated arms. According to another method, securing the central pleated portion of the scrubbing element between the bifurcated arms of the handle of the scrubbing apparatus involves configuring an interior surface of at least one of the bifurcated arms of the handle with material engaging fingers which operably engage with the mesh material forming the scrubbing element thereby securing the central pleated portion of the scrubbing element between the bifurcated arms of the handle. According to another method, securing the central pleated portion of the scrubbing element between the bifurcated arms of the handle of the scrubbing apparatus involves adhering the mesh material forming the scrubbing element to confronting interior surfaces on the bifurcated arms of the handle. This process can further include the step of: covering the adhesive on the bifurcated arms with a protective shield until after the mesh material forming the scrubbing element is arranged between the bifurcated arms of the handle and thereafter removing such protective cover so as to permit the adhesive on the handle to operably engage with the mesh material forming the scrubbing element. Yet another method of securing the central pleated portion of the scrubbing element between the bifurcated arms of the handle of the scrubbing apparatus involves securing the central pleated portion of the scrubbing element in a modular clip or holder which is insertable into operable combination with the handle of the scrubbing apparatus.

To facilitate use of the scrubbing apparatus, the method preferably includes the further step of: forming the handle with a generally L-shape between the first and second ends, respectively. The method furthermore preferably includes the step of: configuring the L-shaped handle to inhibit the scrubbing apparatus from inadvertently falling from structure from which the scrubbing apparatus is freely hung.

In summary, the generally L-shape of the handle of one form of the scrubbing apparatus offers several unique and beneficial characteristics. First, the L-shape of the handle ergonomically enhances the ability to scrub a person's torso, including the back, with both comfort and ease. Second, the generally L-shape of the handle has been found to offer better direction to the scrubbing apparatus during bathing of the human torso, especially the back. Moreover, the generally L-shape of the handle allows the scrubbing apparatus to be freely hung from the shower rod, towel bar and the like upon completion of the cleansing process. The preferred curvilinear configuration of handle section makes it easier for a person using scrubbing apparatus to reach their back and advantageously shifts the center of gravity of scrubbing apparatus to facilitate free hanging of the scrubbing apparatus upon completion of the bathing process.

Suffice it to say, the scrubbing element advantageously offers a smooth cleansing action from either side of the handle during use. Moreover, the elastic netting preferably used to form the scrubbing element is quick to dry as apparatus freely hangs. The ability to secure the scrubbing element at one end of the apparatus furthermore enhances use of the apparatus. Use of a modular scrubbing clip or holder allows a person to replace only the scrubbing element holder or clip having the scrubbing element as part thereof thus resulting in significant cost savings.

From the foregoing, it will be observed that numerous modifications and variations can be made and effected without departing or detracting from the true spirit and novel concept of the present invention. Moreover, it will be appreciated, the present disclosure is intended to set forth an exemplification of the invention which is not intended to limit the invention to the specific embodiment illustrated. Rather, this disclosure is intended to cover by the appended claims all such modifications and variations as fall within the spirit and scope of the claims.

What is claimed is:

1. A human torso scrubbing apparatus, comprising:

a one-piece elongated and generally L-shaped rigid elastomeric handle having a grasping portion toward one end thereof;

a scrubbing element secured to a second end of said handle;

wherein the grasping portion of said handle is offset at an angle ranging between about 75° and about 115° relative to a portion of the handle extending from said scrubbing element so as to facilitate scrubbing of a human's back, with the grasping portion of said handle being joined to the portion of the handle extending from said scrubbing element in an area having a curve; and with said handle further including a projection extending from an inner surface of and further facilitating a person's grasp of the grasping portion of the handle, with said projection serving as an extension of the curved area of and is formed integral with the handle.

2. The human torso scrubbing apparatus according to claim 1, wherein the curved area of said handle has a radius ranging between about 0.657 inches and about 1.5 inches.

3. The human torso scrubbing apparatus according to claim 1, wherein said scrubbing element is comprised of an elastomeric mesh material extending to the inner surface and an outer surface of said handle.

4. A human torso scrubbing apparatus, comprising:

an elongated handle having a generally L-shaped configuration between first and second spaced ends and a curved area disposed intermediate said first and second ends, with the first end of said handle being configured with a pair of bifurcated arms defining an open-ended channel therebetween, with said channel opening to inner and outer surfaces of said handle, and with the second end of said handle being configured to grasp and manipulate said apparatus during use;

an elastomeric scrubbing element insertable into said open-ended channel and between said bifurcated arms such that a portion of said scrubbing element is entrapped between said arms while a remaining portion of said scrubbing element extends from the inner and outer surfaces of said handle;

an apparatus for inhibiting inadvertent movement of that portion of the scrubbing entrapped between said bifurcated arms of said handle; and with said handle further including a projection extending from the inner surface of the handle for facilitating a person's grasp and manipulation of the scrubbing apparatus, with said projection serving as an extension of the curved area and is formed integral with the handle.

5. The human torso scrubbing apparatus according to claim 4, wherein said apparatus for inhibiting inadvertent movement of that portion of the scrubbing entrapped between said arms of said handle includes a member for operably coupling the free ends of the bifurcated arms to each other whereby entrapping said scrubbing element between said arms of said handle.

6. The human torso scrubbing apparatus according to claim 4, wherein said apparatus for inhibiting inadvertent movement of that portion of the scrubbing entrapped between said arms of said handle includes multiple scrubbing element engaging fingers projecting inwardly from and fixed relative to the bifurcating arms of the handle for operably engaging the elastomeric scrubbing element.

7. The human torso scrubbing apparatus according to claim 4, wherein said apparatus for inhibiting inadvertent movement of that portion of the scrubbing entrapped between said arms of said handle includes a scrubbing element clip fixedly insertable between the bifurcated arms of the handle.

8. A human torso scrubbing apparatus, comprising:

an elongated handle having first and second axially spaced ends, with the first end of said handle being configured with a pair of bifurcated arms defining an open-ended channel therebetween, with said channel opening to inner and outer surfaces of said handle;

an elastomeric scrubbing element insertable into said open-ended channel and between said bifurcated arms such that a portion of said scrubbing element is entrapped between said arms while a remaining portion of said scrubbing element extends from the inner and outer surfaces of said handle; and an apparatus for inhibiting inadvertent movement of that portion of the scrubbing entrapped between said bifurcated arms of said handle; and wherein one of said bifurcated arms of said handle is pivotally movable relative to the other of said arms.

9. A human torso scrubbing apparatus, comprising:

an elongated handle having a generally L-shaped configuration between first and second axially spaced ends and a curved area, with a convex radius ranging between about 0.75 inches and about 1.25 inches, disposed intermediate said first and second ends, with the first end of said handle being configured with a pair of bifurcated arms defining an elongated and open-ended channel therebetween, with said channel opening to inner and outer surfaces of said handle and to the first end of said handle, and with the second end of said handle being configured to grasp and manipulate said apparatus during use;

an elastomeric scrubbing element insertable into said open-ended channel and between said bifurcated arms such that a portion of said scrubbing element extends along and is entrapped between said arms while a remaining portion of said scrubbing element extends from the inner and outer surfaces of said handle;

an apparatus for inhibiting inadvertent movement of that portion of the scrubbing entrapped between said bifurcated arms of said handle; and with said handle further including a projection extending from the inner surface of the handle for facilitating a person's grasp and manipulation of the scrubbing apparatus, with said projection serving as an extension of the curved area and is formed integral with the handle.

10. The human torso scrubbing apparatus according to claim 9, wherein the convex radius of the curved area on said handle projects inwardly from said inner surface and extends toward said outer surface of said handle.

11. The human torso scrubbing apparatus according to claim 9, wherein said apparatus for inhibiting inadvertent movement of that portion of the scrubbing entrapped between said bifurcated arms of said handle includes a scrubbing element holder insertable between the bifurcated arms of said handle.

12. An apparatus for facilitating a person's reach to a rear area of a human torso, said apparatus comprising:

a handle having a first elongated curvilinear section joined in a generally L-shaped configuration relative to a second grasping section which is shorter in length than said first elongated section, and with said first and second sections being joined to each other in an area having a curve, and with the curvilinear section of the handle having a human torso engaging element at a distal end thereof, and wherein the grasping section of said handle further includes a projection extending from an inner surface of and further facilitating the person's grasp of the grasping section of the handle, with said projection being disposed so as to serve as an extension of the curved area and is formed integral with the handle.

13. The apparatus for facilitating a person's reach to a rear area of a human torso according to claim 12 wherein the curved area of said handle has a radius ranging between about 0.657 inches and about 1.5 inches.

* * * * *